US006449915B1

(12) United States Patent
Park

(10) Patent No.: US 6,449,915 B1
(45) Date of Patent: Sep. 17, 2002

(54) INNER WALL FINISHING HUMIDITY CONTROL PANEL OF CULTURAL PROPERTY STOREHOUSE

(75) Inventor: Ki-Seok Park, Seoul (KR)

(73) Assignee: Time & Space Tech. Co., Ltd., Seoul (KR)

( * ) Notice: Subject to any disclaimer, the term of this patent is extended or adjusted under 35 U.S.C. 154(b) by 0 days.

(21) Appl. No.: 09/465,785

(22) Filed: Dec. 17, 1999

(30) Foreign Application Priority Data

Dec. 23, 1998 (KR) ..... 98-26235

(51) Int. Cl.[7] ..... E04B 1/74

(52) U.S. Cl. ..... 52/407.1; 52/302.1; 52/302.3; 52/506.01; 52/784.14; 52/796.1; 156/78; 156/260; 156/288; 156/290; 156/296; 156/299; 428/54; 428/55; 428/56; 428/99; 428/105; 428/192

(58) Field of Search ..... 52/302.1, 302.3, 52/796.1, 784.14, 506.01, 407.1; 156/290, 288, 78, 299, 296, 260; 428/54, 55, 56, 99, 105, 192

(56) References Cited

U.S. PATENT DOCUMENTS 3,387,420 A * 6/1968 Long ..... 52/302
4,284,447 A * 8/1981 Dickens et al. ..... 156/78
4,295,415 A * 10/1981 Schneider, Jr. ..... 98/31
4,937,990 A * 7/1990 Paquette ..... 52/199
5,369,926 A * 12/1994 Borland ..... 52/302.1
5,473,847 A * 12/1995 Crookston ..... 52/302.1
5,561,958 A * 10/1996 Clement et al. ..... 52/407.1

* cited by examiner

*Primary Examiner*—Carl D. Friedman
*Assistant Examiner*—Christy Green
(74) *Attorney, Agent, or Firm*—Birch, Stewart, Kolasch & Birch, LLP

(57) ABSTRACT

A wall panel structure for controlling humidity within a building having a panel assembly attachable to an inner wall surface of the building including: a first panel having a surface with a first predetermined porosity to moisture; and a second panel secured to said first panel with a space for accomodating airflow between the first and second panels, the second panel having a surface with a second predetermined porosity to moisture, the first perdetermined panel porosity being greater than the second predetermined porosity to thereby absorb moisture from air being circulated between the first and second panels; whereby humidity of an environment within the building is controllable. The first and second panels are fabricated from compressed wood particles, a first compression density of the first panel being selected to achieve the first predetermined porosity and a second compression density of the second panel being selected to achieve the second predetermined porosity, the first compression density being less than the second compression density. Airflow channels are formed in a criss-cross pattern in the second panel to facilitate air circulation between the panels.

9 Claims, 5 Drawing Sheets

INNER WALL FINISHING HUMIDITY CONTROL PANEL OF CULTURAL PROPERTY STOREHOUSE

BACKGROUND OF THE INVENTION

The present invention relates to an inner wall finishing humidity control panel of a cultural property storehouse for safely storing valuable cultural properties of nations from moisture.

In general, temperature and humidity should be properly maintained in order to safely store the valuable cultural properties such as relics of nation, and particularly original forms of cultural property can be eternally and safely stored only when a suitable temperature and humidity is constantly maintained in response to material characteristics of each cultural property.

As a prior art cultural property storehouses for the above, an inner wall finishing material has been used by processing a paulownia and Japanese cedar as a typical wood having a characteristics of absorbing and discharging the humidity, but since aforesaid woods repeat contraction and expansion according to continuous absorbing and discharging operation of humidity, deformation by cracking, chinking or bending may occur. Against these deformation phenomena, in case of finishing the storehouse inner wall by only raw wood without a separate supplementing measure, heat and humidity and other various pollution factors to the exterior storehouse may cause deformation due to contraction and expansion cause moisture to enter the interior, and thereby a predetermined temperature and humidity environment can not be maintained. The storehouse interior finishing material has an advantage in that an absorbing and discharging capacity of humidity is excellent, while it has the disadvantage that a deformation such as crack and bending due to continuous absorbing and discharging operation may occur.

And, in controlling the storehouse temperature and humidity, there is a need for a method for constantly maintaining the temperature and humidity of storehouse interior by continuously driving a constant temperature and humidity control device, and the aforesaid constant temperature and humidity control device has the function of controlling air to a predetermined temperature and humidity by circulating the air via mechanical force so that the cultural property is safely stored by properly controlling the temperature and humidity required by the cultural property stored in the storehouse.

However, since aforementioned constant temperature and humidity control device can constantly maintain the temperature and humidity of the storehouse interior only by continuously driving, there has been an economical problem requiring much of maintenance and operating cost. In case when the constant temperature and humidity control device would be damaged, the operation would be stopped for long time due to damage. Therefore, there has been a problem that the temperature and humidity of storehouse interior cannot be maintained to a predetermined level so that the cultural property would be damaged.

OBJECT AND SUMMARY OF THE INVENTION

Therefore, the present invention is invented by considering such a problem as described above, and it is an object of the present invention to provide an inner wall finishing humidity control panel of a cultural property storehouse which is made such that in making a humidity control panel of wood material having a characteristic for absorbing and discharging moisture to the interior of inner wall of the storehouse constructed by non-permeating panel for isolating the permeation of moisture to be used as storehouse inner wall finishing material. The humidity control panel itself reacts to humidity change existing in air within the storehouse, even if a driving of constant temperature and humidity control device is stopped for a long time, so that the humidity can be maintained to an appropriate level by means of forming an air circulating path to said humidity control panel itself.

The objects of the invention are fulfilled by providing:

A wall panel structure for controlling humidity within a building comprising:

a first panel attachable to an inner wall surface of the building, said first wall panel having a surface with a first predetermined porosity to moisture; and a second panel secured to said first panel with a space for accomodating airflow between the first and second panels, said second panel having a surface with a second predetermined porosity to moisture, said first predetermined panel porosity being greater than said second predetermined porosity to thereby absorb moisture from air being circulated between the first and second panels; whereby humidity of an evironment within the building is controllable.

The first and second panels are fabricated from compressed wood particleboard, a first compression density of the first panel being selected to achieve said first predetermined porosity and a second compression density of said second panel being selected to achieve said second predetermined porosity, said first compression density being less than said second compression density.

The first compression density of wood particles in said first panel is achieved by pressure thereon of 330–380 $Kg/cm^3$, and the second compression density of wood particles on said second panel is achieved by pressures thereon of 680–730 $Kg/cm^3$.

The first and second panels are formed with criss-crossed airflow channels therebetween, preferably formed in the stronger second panel, and are attached together by criss-crossed strands of adhesive material.

DETAILED DESCRIPTION OF THE PREFERRED EMBODIMENTS

Figure 1:
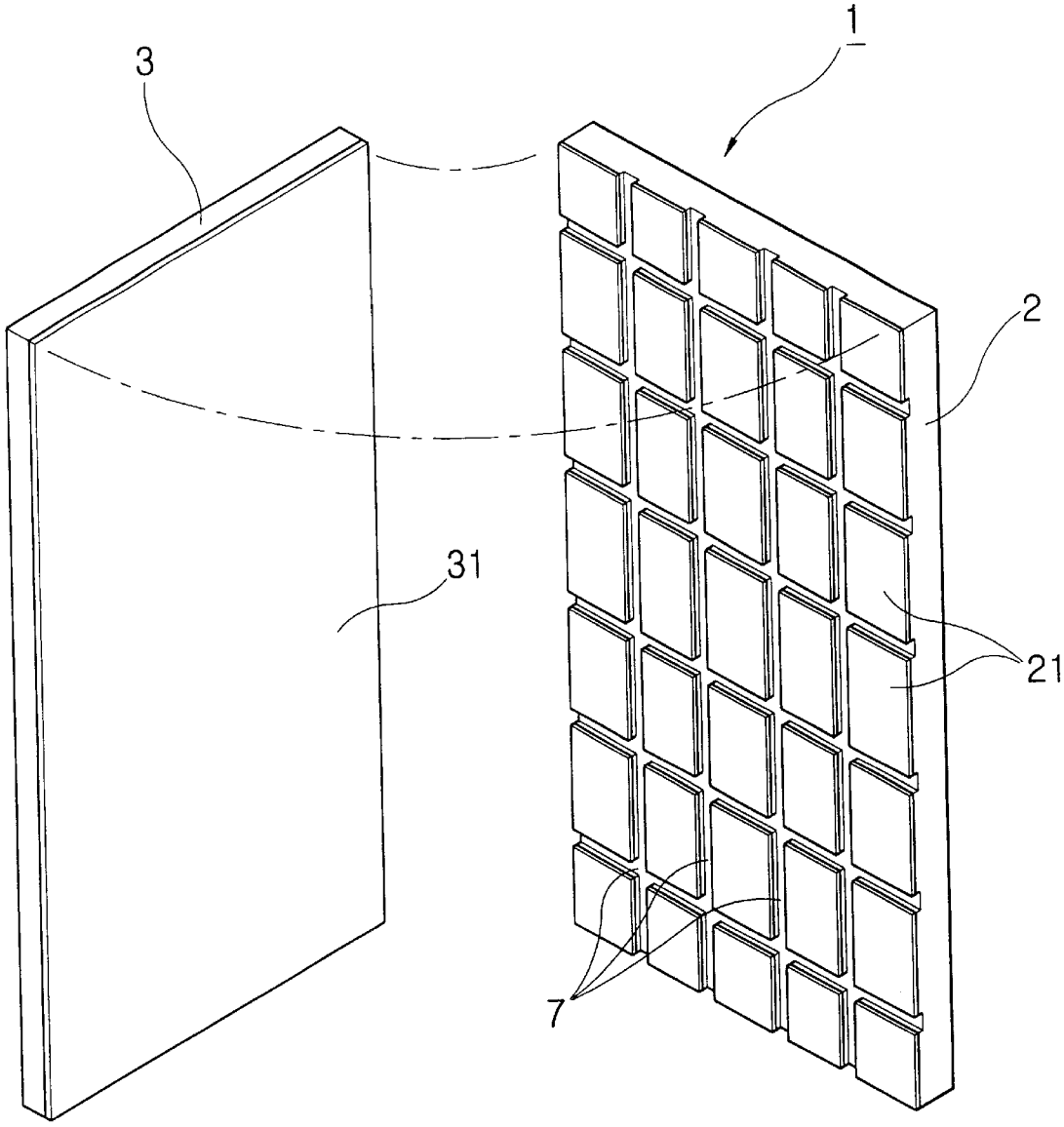
FIG. 1 is an exploded perspective view of humidity control panel of the present invention.

Hereinafter, a preferred embodiment of the present invention will be described in detail with reference to the accompanying drawings.

In the drawings, a reference numeral 1 shows a humidity control panel for finishing and processing an inner wall, and the humidity control panel 1 is integrally adhered by an adhesive agent with soft compressed particleboard panel 2 and heavy particleboard panel 3. The soft and heavy particleboard panels 2, 3 are adhered adhesive agent layers 21, 31 in a state before adhering to each of soft and heavy particleboard panels 2, 3 and in a state that the adhering agent layers 21, 31 are previously coated to their adhering surfaces.

The soft fabric panel 2 and the heavy particleboard panel 3 are made from waste wood after lumbering raw wood of pine tree and the like, or from planing refuse or sawdust pulverized to a magnitude of about 0.5–3.0 mm and these are compressed and molded as raw material. Soft particleboard panel 2 is molded to a low density compressed by a pressure of 330–380 $Kg/cm^3$, and since fine pores absorbing a moisture are distributed therethrough, it has a characteristics for absorbing moisture when the humidity is more than a set value within air of a storehouse interior IN. On the contrary, it functions to discharge the moisture when moisture is less. And, the heavy particleboard panel 3 is molded to a high density by compression to a pressure of 680–730 $Kg/cm^3$. Panel 3 has a characteristics such that pores absorbing the moisture are formed with less density than the soft particleboard panel 2. However, panel 3 has compressive strength possessed by the inner wall finishing material of the storehouse.

Figure 2:
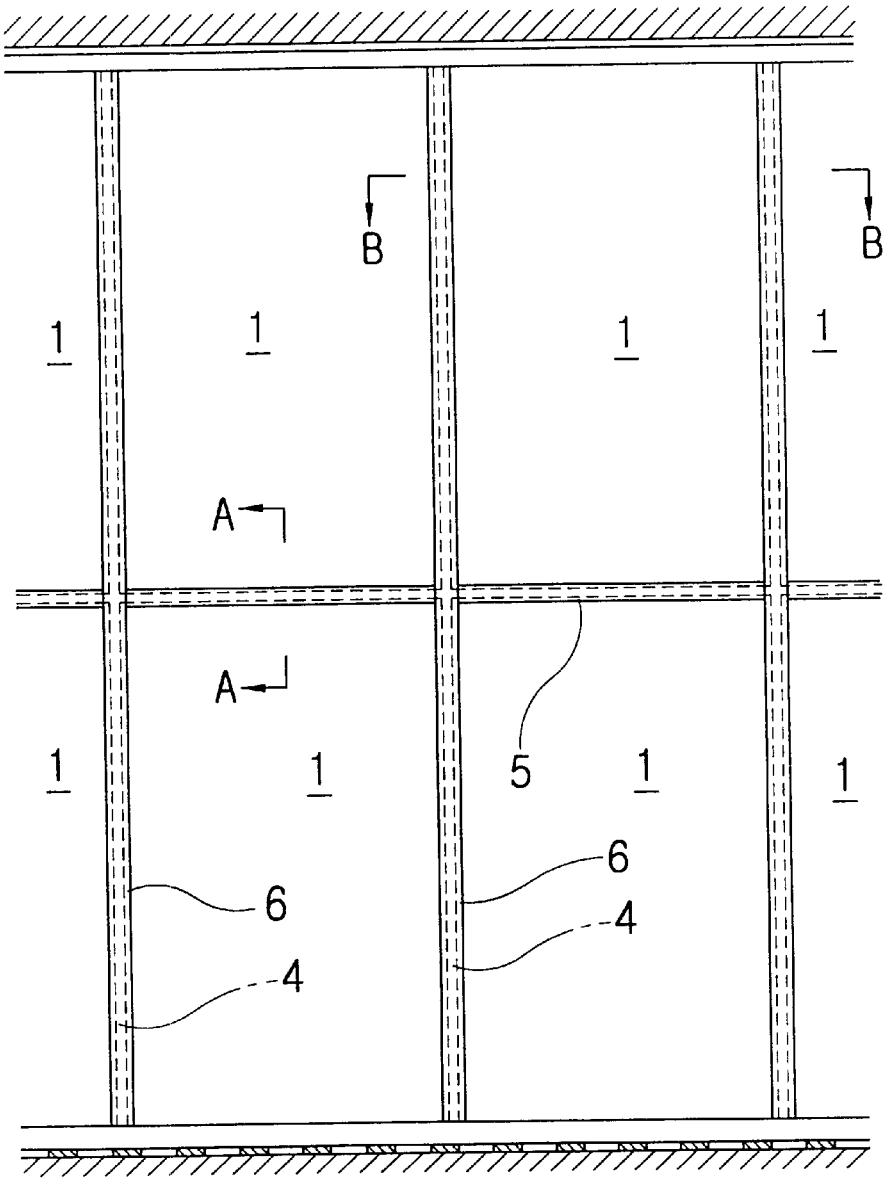
FIG. 2 is an exemplary front view showing an embodiment of the humidity control panel of the present invention.
Figure 3:
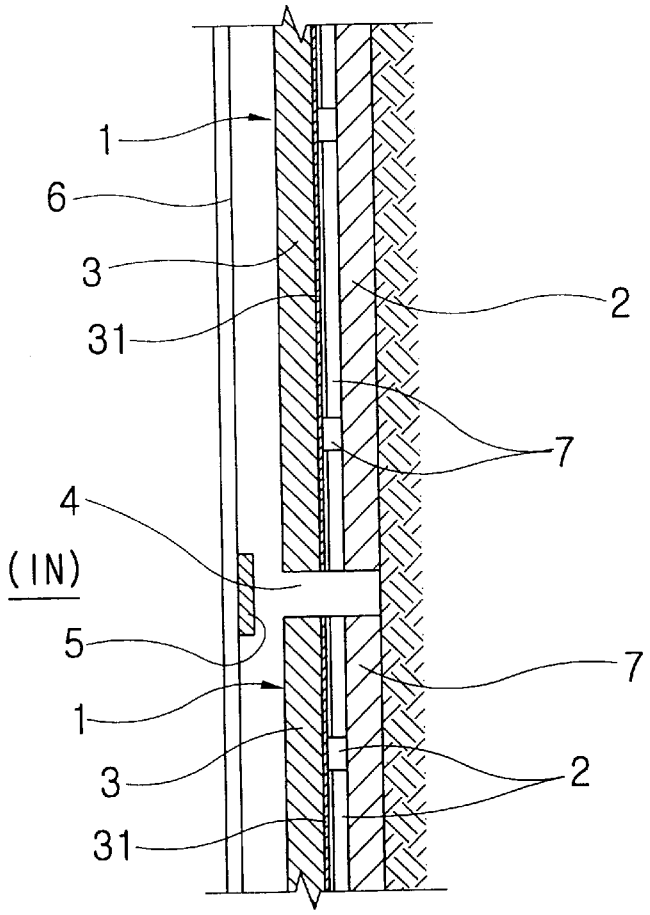
FIG. 3 and FIG. 4 are cross sectional views taken along lines B–B and A–A of FIG. 2, and FIG. 5 to FIG. 8 are cross sectional views for various embodiments of air circulating path of humidity control panels of the present invention.
Figure 4:
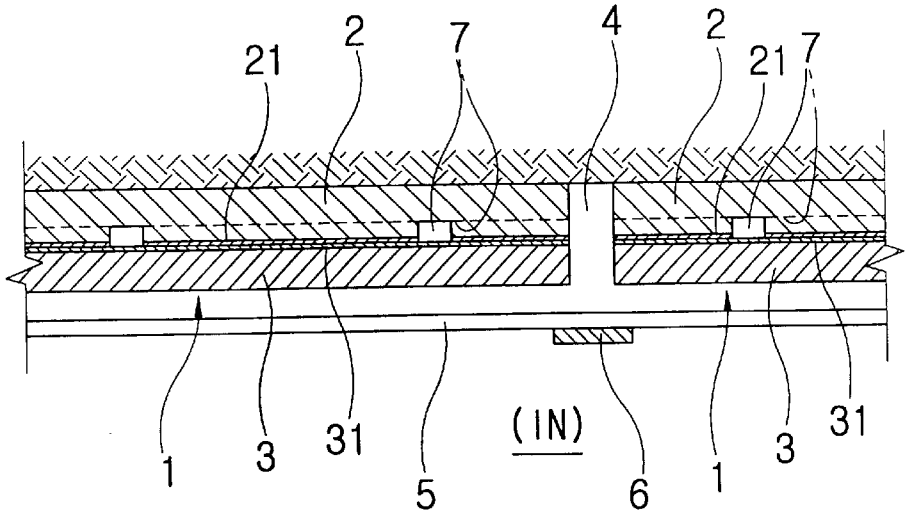

The humidity control panel 1 is spaced at a predetermined distance so as to be formed with air flow-in-out path 4 capable of flowing an air toward up, down, right and left as in FIG. 2 as installed to inner wall of storehouse. The air flow-in-out path 4 is covered by a crosswise band sheet 5, a lengthwise band sheet 6, and an air circulating path 7 is formed to the humidity control panel 1 so that air flowed in through the air flow-in-out path 4 can be circulated within interior of the humidity control panel 1.

The air-circulating path 7 is preferably formed in soft particleboard panel 2 of low density being more absorbant to moisture than the heavy particleboard panel 3 compressed and molded at high density. The air-circulating path 7 is formed by cutting channels and lengthwise by utilizing a cutting tool. An adhesive layer 21 is coated on the adhering surface of the soft particleboard panel 2, and thereby the air-circulating path 7 becomes with adhesive layer 21.

The air circulating path 7 is constructed such that a multiplicity of channels are formed to crosswise and lengthwise by a predetermined distance such that the air circulates through the whole of interior of the humidity control panel 1, so that an absorbing operation of moisture contained within air is smoothly made at the same time a discharging operation of absorbed moisture is made.

Figure 5:
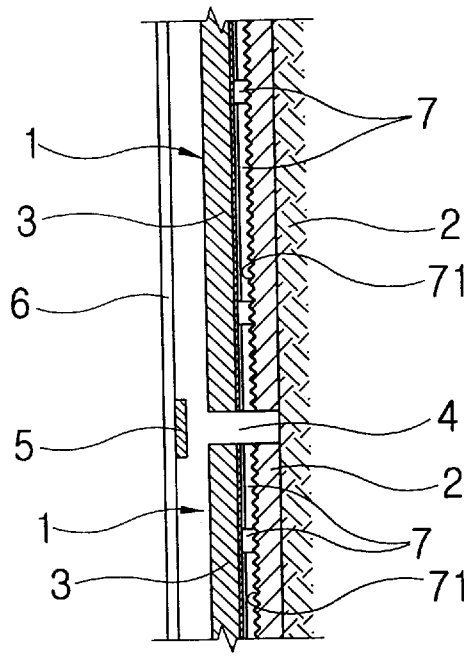
Figure 6:
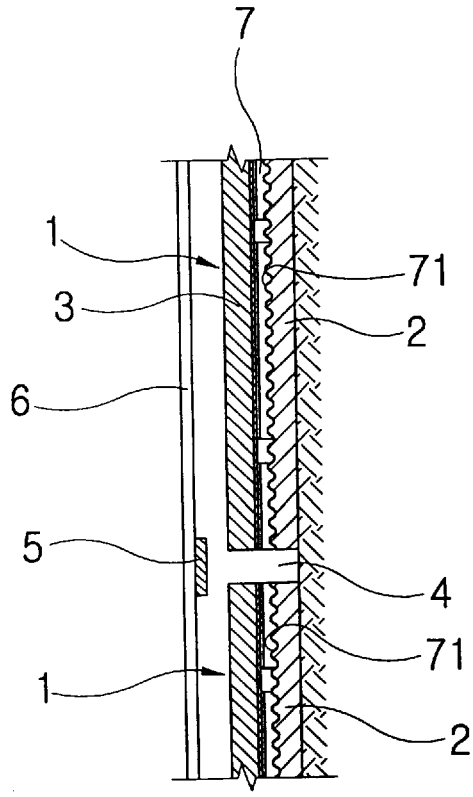
Figure 7:
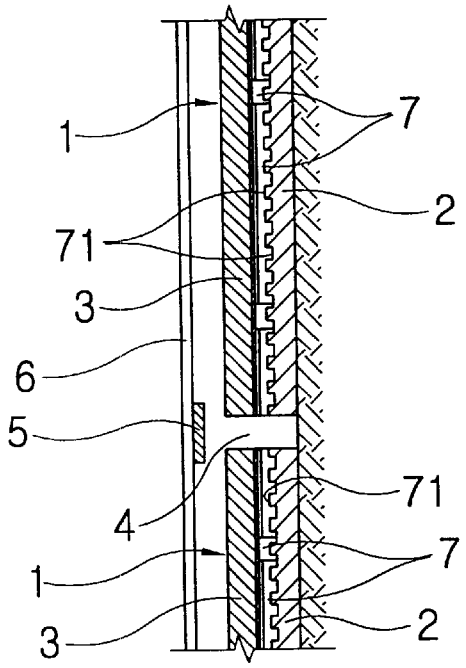

On the other hand, it may be constructed such that an inner surface of the air circulating path 7 is formed in concave and convex surface 71, such as in mountain patterns or wave patterns as in FIGS. 5 to 7, thereby increasing the inner cross sectional area so that the contact area to the air is broadened whereby an absorbing operation or a discharging operation of moisture is more efficiently made.

Operation and effect of the present invention constructed in accordance with preferred embodiments will be described more in detail as follows.

The humidity control panels I are provided continuously to right and left at one stage or two stages in all directions of inner walls in a storehouse, and since the humidity control panels 1 are respectively distanced apart at a predetermined distance in all directions and form the air flow-in-out path 4 the air circulated by convective operation within storehouse interior IN is flowed into the air flow-in-out path 4 and then circulated around the air circulating path 7 formed to crosswise and lengthwise in all directions of the humidity control panel 1, and since the air circulating path 7 formed to the soft particleboard panel 2 is a state that the adhesive layer 21 is excluded, the circulating air is directly contacted to the soft particleboard panel 2, so that the operation is smoothly made in which the soft particleboard panel 2 absorbs the moisture contained within air or discharges to the circulating air.

That is, it has a characteristics that in case when a humidity within air circulated to the air circulating path 7 is higher than a predetermined set value, the soft particleboard panel 2 absorbs the moisture whereby decreases to the humidity of previously set value, on the contrary to this, in case when the humidity within air is lower than previously set value, the moisture having been absorbed is discharged. Accordingly, in case when the air humidity within storehouse interior IN is higher than a predetermined set value, since the moisture within air is absorbed in the fine pores of the soft particleboard panel 2, whereby the air moves within the interior of the air flow-in-out path 4, the air discharged again to the storehouse interior IN after passing the air circulating path 7 of each humidity control panel 1 is discharged in a state that the moisture is decreased as much as the moisture absorbed to the soft particleboard panel 2 of the humidity control panel 1 so that the air humidity within storehouse interior IN can be decreased. The operation as above is continuously performed in case when the air humidity within storehouse interior IN is higher than the predetermined set value, and on the contrary, in a case when a dried air being lower in humidity than predetermined value is circulated to the air circulating path 7. Since the soft particleboard panel 2 discharges the moisture having been absorbed previously, the air discharged to the storehouse interior IN after circulating the air flow-in-out path 4 of the soft particleboard panel 2 has humidity higher than the humidity at a time being flowed, so that it becomes to an operation which makes the humidity within the storehouse to be higher.

The humidity control panel 1 absorbs the moisture and controls temperature and humidity within the storehouse interior IN by driving a constant temperature and humidity control device. The constant temperature and humidity control device is stopped, the humidity is slowly decreased, since the moisture has been absorbed. Even if the driving is stopped only during a predetermined time period without continuously driving the constant temperature and humidity control device for 24 hours, the air humidity within the storehouse interior IN can be maintained at appropriate level of predetermined value, but also the air humidity can be adequately controlled in case when the constant temperature and humidity control device is damaged as well. Thus, the humidity within storehouse interior is controlled at appropriate level during repairing a damage of the constant temperature and humidity control device.

On the other hand, an operation, in which the moisture is absorbed and stored to the soft particleboard panel 2 when the humidity within storehouse interior IN is higher than a predetermined level, and while the moisture being absorbed and stored is discharged when the humidity is lower, is made by a cross sectional area of the air circulating path 7 which contacts the air. And when the inner surface of the air circulating path 7 is formed to a concave and convex surface 71 as in FIGS. 5 to 7, a contacting area to the air becomes bigger, and thereby not only an absorbing or discharging operation of moisture is increased, but also the concave and convex surface 71 disturbs a flow of air, whereby it makes the air to be slowly circulated within the air circulating path 7, so that the absorbing or discharging operation of moisture is further improved.

Figure 8:
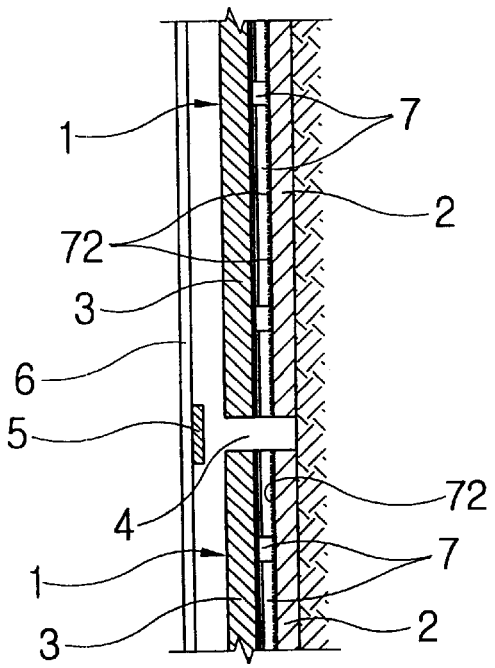

Further, as an embodiment of FIG. 8, when the inner surface of the air circulating path 7 is napping processed, and a napped surface 72 increased with empty gap rate of napped particle is formed, the increased empty gap of the napped surface 72 becomes bigger in absorbing capacity of moisture, and a humidity control capacity is also improved, and such a napped surface 72 exhibits the same feature as the concave and convex surface 71 of aforementioned embodiment.

And, as aforementioned embodiment, a reason why the air circulating path 7 is formed to the soft particleboard panel 2 side and it is not formed to the heavy particleboard panel 3 is in order to maintain strength upon manufacture to be possessed as it is because the heavy particleboard panel 3 is secured to surface of a storehouse interior IN, and it should possess a strength capable of bearing against any shock of material object, if the air circulating path is formed to the heavy particleboard panel 3, and since the strength becomes weaker as much as cutting processed for forming the air circulating path whereby it could not keep to shock strength needed for an inner wall finishing material, the air circulating path 7 is formed to the soft particleboard panel 2 in this invention.

In accordance with the present invention, since the humidity control panel constructing inner wall of storehouse automatically controls humidity within a storehouse interior via an operation for absorbing or discharging the moisture by itself, there is an effect that humidity within storehouse interior is controlled suitably to a previously set predetermined value even if the constant temperature and humidity control device is stopped for a predetermined time period without continuously driving for 24 hours. Therefore, an absorbing and discharging operation of moisture is improved by forming the air circulating path to the soft particleboard panel, and also there is an effect capable of preventing a case that the cultural property is damaged due to change of humidity since a humidity required by cultural property stored in a storehouse interior can be maintained. Further, the heavy particleboard panel of the humidity control panel protects the soft particleboard panel as the wall of a storehouse interior possesses sufficient strength.

What is claimed is:

1. A wall panel structure adapted for controlling humidity within a building comprising:

a first panel attachable to an inner wall surface of the building, said first wall panel having a surface with a first predetermined porosity for absorbing moisture from air in the building or desorbing moisture therefrom into the air; and a second panel secured to said first panel with a space for accommodating airflow between the first and second panels, said second panel having a surface with a second predetermined porosity for absorbing/desorbing the moisture, said first predetermined panel porosity being greater than said second predetermined porosity to thereby absorb/desorb more moisture in the first panel than in the second panel from air being circulated between the first and second panels;

the first and second panels being fabricated from compressed particles, a first compression density of the first panel being selected to achieve said first predetermined porosity and a second compression density of said second panel being selected to achieve said second predetermined porosity, said first compression density being less than said second compression density;

whereby humidity of an environment within the building is controllable by the first and second porosities of the first and second panels, and the absorbing/desorbing of moisture from the first and second panel surfaces.

2. The wall panel structure of claim 1 wherein the first compression density of particles in said first panel is achieved by pressure thereon of 330–380 $Kg/cm^3$, and the second compression density of particles on said second panel is achieved by pressures thereon of 680–730 $Kg/cm^3$.

3. The wall panel structure of claim 2 wherein the first and second panels are formed with criss-crossed airflow channels therebetween.

4. The wall panel structure of claim 3 wherein the first and second panels are attached together by criss-crossed strands of adhesive material.

5. The wall panel structure of claim 1 wherein the first and second panels are formed with criss-crossed airflow channels therebetween.

6. The walk panel structure of claim 5 wherein the first and second panels are attached together by criss-crossed strands of adhesive material.

7. The wall panel structure of claim 6 wherein the criss-crossed channels are formed in said second panel.

8. The wall panel structure of claim 4 wherein the criss-crossed channels are formed in said second panel.

9. The wall panel structure of claim 1 wherein said particles are wood.

* * * * *